US008764475B2

(12) United States Patent
Maher et al.

(10) Patent No.: US 8,764,475 B2
(45) Date of Patent: Jul. 1, 2014

(54) WEATHER-RESISTANT CABLE CONNECTOR, ELECTRICAL MODULES AND WEATHER-RESISTANT ASSEMBLIES THEREOF

(75) Inventors: David Maher, Kilcornan (IE); Kieran Wright, Ennis (IE); Maurice Shanahan, Westbury (IE)

(73) Assignee: Molex Incorporated, Lisle, IL (US)

( * ) Notice: Subject to any disclaimer, the term of this patent is extended or adjusted under 35 U.S.C. 154(b) by 231 days.

(21) Appl. No.: 13/144,596

(22) PCT Filed: Oct. 9, 2009

(86) PCT No.: PCT/US2009/060225

§ 371 (c)(1),
(2), (4) Date: Sep. 29, 2011

(87) PCT Pub. No.: WO2010/082967

PCT Pub. Date: Jul. 22, 2010

(65) Prior Publication Data

US 2012/0135632 A1 May 31, 2012

Related U.S. Application Data

(60) Provisional application No. 61/144,679, filed on Jan. 14, 2009.

(51) Int. Cl.
*H01R 4/24* (2006.01)
*H01R 13/52* (2006.01)

(52) U.S. Cl.
CPC ..... *H01R 4/2404* (2013.01); *H01R 13/5216* (2013.01); *H01R 13/5219* (2013.01); *H01R 4/24* (2013.01)
USPC ..... 439/391

(58) Field of Classification Search
CPC ..... H01R 4/2404; H01R 4/404; H01R 12/67; H01R 4/2433; H01R 13/523; H01R 13/5216; H01R 13/5219
USPC ..... 439/417, 425, 393, 391
See application file for complete search history.

(56) References Cited

U.S. PATENT DOCUMENTS 4,351,582 A * 9/1982 Emerson et al. ..... 439/405
4,533,200 A * 8/1985 Wilson ..... 439/395

(Continued)

FOREIGN PATENT DOCUMENTS

EP 1 286 419 A2 2/2003
EP 1 487 064 A1 12/2004

(Continued)

OTHER PUBLICATIONS

International Search Report for PCT/US2009/060225.

*Primary Examiner* — Briggitte R Hammond
(74) *Attorney, Agent, or Firm* — Larry I. Golden

(57) ABSTRACT

The present disclosure is directed cable connectors (14), electrical modules (12) and assemblies thereof. The cable connectors can provide a sealed connection having a rating of IP 66/67 between electrical modules such as lighting fixtures and an insulated cable (16). Cable connectors can be quickly and easily engaged and disengaged with electrical modules to create customizable electrical assemblies. The cable connector can have an upper portion (22) having piercing pins (26) for penetrating the cable at one end and contacting terminals (76) of the module at another end, and a lower portion for clamping against the cable and locking to the upper portion. A gel mat (44A) can be provided in an area surrounding the piercing pins for sealing the area from water and dust. The module can include a skirt for engaging with an elastomeric sleeve on the upper portion to create a seal when the module is mated with the cable connector.

13 Claims, 10 Drawing Sheets

(56) References Cited

U.S. PATENT DOCUMENTS

| | | | | |
|---|---|---|---|---|
| 4,685,756 | A * | 8/1987 | Gamarra | 439/426 |
| 4,995,828 | A * | 2/1991 | Goodman et al. | 439/405 |
| 6,551,124 | B1 * | 4/2003 | Gossmann | 439/411 |
| 6,986,608 | B2 * | 1/2006 | Choudhury et al. | 385/59 |
| 7,056,137 | B1 * | 6/2006 | Vall Gendre et al. | 439/271 |
| 7,530,827 | B2 * | 5/2009 | Caveney et al. | 439/211 |
| 7,922,541 | B2 * | 4/2011 | Maenhout et al. | 439/625 |
| 2007/0249214 | A1 * | 10/2007 | Lamdiziz et al. | 439/417 |

FOREIGN PATENT DOCUMENTS

| | | | |
|---|---|---|---|
| GB | 2 429 514 | A | 2/2007 |
| WO | WO 01/22534 | A1 | 3/2001 |

* cited by examiner

WEATHER-RESISTANT CABLE CONNECTOR, ELECTRICAL MODULES AND WEATHER-RESISTANT ASSEMBLIES THEREOF

BACKGROUND

The present disclosure is generally directed to cable connectors and electrical modules, the assembly of which allows creation of larger electrical assemblies. Specifically, the cable connectors of the present disclosure electrically connect lighting or other electrical modules to an insulated cable. Even more specifically, the disclosure is directed to weather-resistant cable connectors which can connect lighting or other electrical modules to an insulated cable in the field to permit customized lighting or electrical systems.

Electrical systems such as large lighting or video displays typically must be custom made. Custom made systems have the distinct disadvantage of being limited to a single use. In addition, custom made electrical systems may require that the system be completely or at least significantly preassembled. Transporting such preassembled systems can be difficult, costly and can result in damage to the system.

While modular electrical systems do exist, current systems have some shortcomings. For example, modular lighting systems are available to create large lighting displays. These systems however are limited to only lighting modules and do not have the flexibility to add other electrical modules having different functionality. Also for outdoor electrical systems such as large outdoor light or video displays, resistance to water may be necessary. In order to be resistant to typical outdoor conditions such as rain and also permit cleaning of the light displays with commonly used tools such as power washers, outdoor light or video displays have required secondary containment or housing structures.

Customizable electrical systems for indoor and outdoor use would be desirable. The ability to assemble such customizable electrical systems in the field and permit reuse and reconfiguration of the system would be of additional benefit.

Accordingly, the present disclosure provides cable connectors affording a sealed electrical connection to an insulated cable and electrical modules that can be quickly and easily connected to and disconnected from the cable connector in a sealed manner. In addition, the cable connectors of the present disclosure allow efficient and repeated engagement and disengagement of different electrical modules to the cable connector to create a variety of customizable systems that can have high resistance to water penetration.

SUMMARY

In one aspect of the present disclosure, a cable connector for terminating an insulated cable having wire strands is provided. The cable connector comprises an upper portion having a top end for interacting with an electrical module, a bottom end for interacting with insulated cable and a plurality of cavities extending therebetween; a first recessed area; a first gel mat positioned in the recessed area and a plurality of piercing pins, each piercing pin having a piercing end extending outward from the bottom end and through the first gel mat and a slotted opening opposite the piercing end seated in one of the cavities. The cable connector also comprises a lower portion lockable to the upper portion and having a cable receiving end. The cable receiving end has a second recessed area aligned with the first recessed area when upper and lower portions are locked together and a second gel mat positioned in the second recessed area wherein placement of insulated cable on receiving end of lower portion and locking of upper portion to lower portion causes piercing pins to penetrate insulated cable and to make contact with wire strands and first and second gel mats to compress and flow to seal penetrated insulated cable.

In another aspect of the present disclosure, a cable connector for sealed connections to an electrical module and to a stranded-wire insulated cable is provided. The cable connector comprises lockable upper and lower portions. The upper portion includes a first end for mating to an electrical module and a second end for interfacing with the stranded-wire insulated cable, a plurality of openings extending from the first end to the second end, a recessed area having a gel mat received therein, a plurality of piercing pins, each piercing pin having a piercing end and a slotted opening at an opposite end. Each of the plurality of openings seats the one of the plurality of piercing pins and the piercing end of each piercing pin extends from the second end and through the gel mat, wherein placement of the cable between upper and lower portions and locking of upper portion to lower portion causes piercing ends to penetrate the stranded-wire insulated cable and make contact with conductors therein and the gel mat to seal connection between piercing pins and conductors.

In yet another aspect of the present disclosure, an electrical assembly is provided. The electrical assembly comprises a cable connector for terminating a stranded-wire insulated cable and for releasably attaching to an electrical module to electrically connect the electrical module to the stranded-wire insulated cable. The electrical module includes a bottom end for interacting with the cable connector, a top end, a plurality of terminal pins with each terminal pin secured in a passage and having a first end extending out the top end and a second end extend out the bottom end, and a skirt for sealing engagement with the cable connector. The cable connector includes an upper portion and lower portion lockable against the stranded-wire insulated cable. The upper portion includes an upper end for interacting with electrical module and a lower end for interacting with the stranded-wire insulated cable; a first recessed area having a first gel mat seated therein; and a plurality of piercing pins. Each piercing pin has a slotted opening opposite a piercing end. The slotted opening of each piercing pin is positioned in a cavity having a hole at the upper end of the upper portion and the piercing end extends out of a hole at the lower end of the upper portion and passes through the first gel mat. Each hole at the upper end of the upper portion receives the bottom end of one of the plurality of terminal pins for mating with the slotted opening of one of the plurality of piercing pins to electrically connect the electrical module to the cable connector. The lower portion includes a cable facing end wherein the stranded-wire insulated cable is positioned on the lower portion and locking upper portion to lower portion causes piercing ends to penetrate stranded-wire insulated cable and contact conductors therein to electrically connect cable connector to stranded-wire insulated cable and causes first gel mat to seal the terminated stranded-wire insulated cable.

DETAILED DESCRIPTION

It is to be understood that the disclosed embodiments are merely exemplary of the disclosure, which may be embodied in various forms. Therefore, specific details disclosed herein are not to be interpreted as limiting, but merely as a representative basis for teaching one skilled in the art to variously employ the inventive features herein disclosed in virtually any appropriate manner.

The present disclosure provides a modular electrical assembly of a cable connector allowing a sealed electrical connection to an insulated cable that can be resistant to water and dust infiltration, and exchangable electrical modules combined with the cable connector in a sealed manner to create customized electrical systems that can be highly weather-resistant and water-proof.

Figure 1:
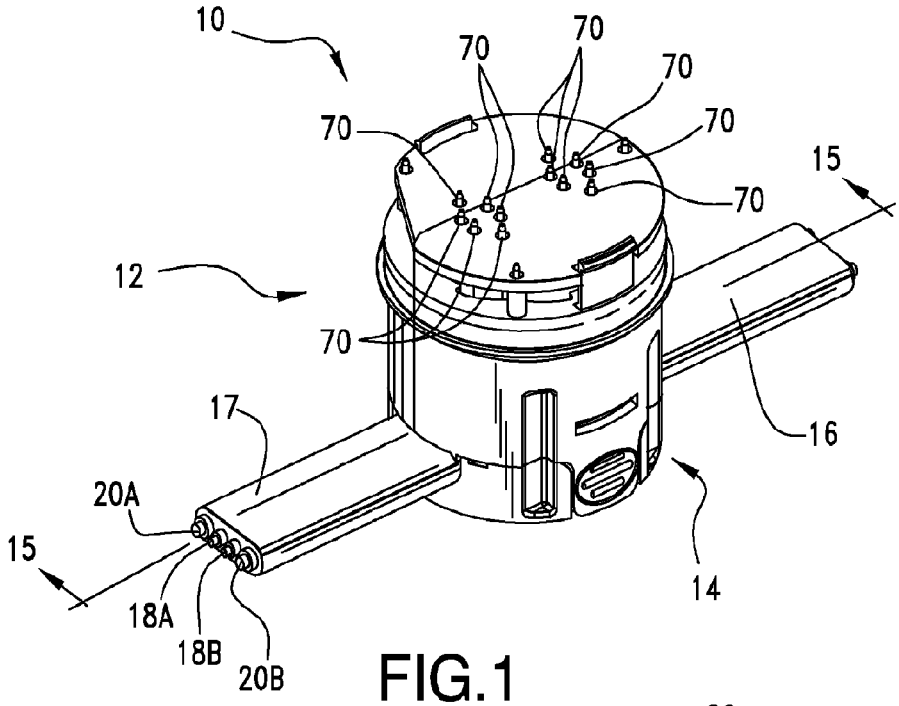
FIG. 1 shows a perspective view of one embodiment of an electrical assembly according to the present disclosure.
Figure 2:
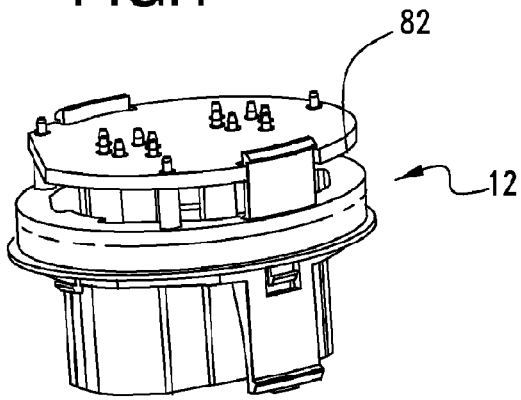
FIG. 2 shows a perspective view of the electrical assembly shown in FIG. 1 with one embodiment of an electrical module separated from one embodiment of a cable connector.
Figure 2:
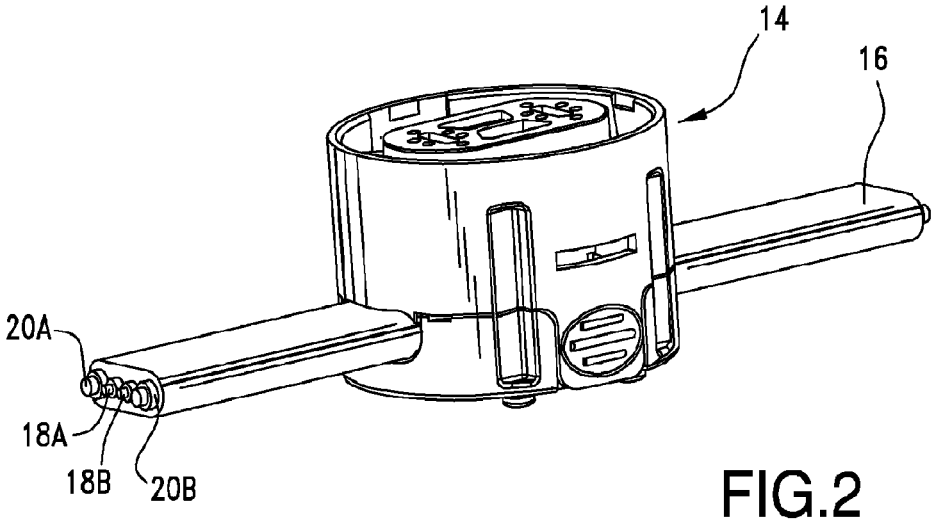

FIGS. 1 and 2 show one embodiment of modular electrical assembly 10 according to the present disclosure. Assembly 10 can include electrical module 12 that can have a push-on pull-off connection to cable connector 14. Cable connector 14 electrically connects cable 16 to module 12 to provide signal and/or power to module 12. The connections between cable connector 14 and insulated cable 16 and between module 12 and cable connector 14 can be sealed. The sealed connections between module 12 and cable connector 14 and cable connector 14 and cable 16 can result in assembly 10 having a rating of IP 66/67. The sealed connection between cable connector 14 and insulated cable 16 can have a rating of IP X4.

Cable 16 can be a stranded wire insulted cable which can be supplied in reels and have a desired UL rating. In the embodiment shown in FIG. 2 cable 16 can have two inner bundles 18A, 18B of stranded wire for transmitting signals and two outer bundles 20A, 20B of stranded wire for transmitting power. In one embodiment cable 16 can be rated to 16 amps and 48 volts. Cable 16 can also have a UV rated outer jacket 17. In one embodiment jacket 17 can be polyurethane and can have a thickness of about 1.2 mm.

Reeled cable 16 can be rolled out to any length and modules 12 can be connected at specified locations or intervals along cable 16 using cable connectors 14. Cable connector 14 can be quickly and easily applied to cable 16 allowing for onsite construction. Module 12 can have a simple push-on and pull-off mating to connector 14 without the need for tools or strenuous effort.

Modules 12 can provide a number of different functions depending on the type of module used. For example, in the embodiment shown in FIGS. 1 and 2, module 12 can be an LED connector which allows addition of an LED fixture to provide lighting. Multiple assemblies 10 on a length of cable 16 having LED connector modules 12 can be combined to create large LED video or lighting displays. If any LED fixtures break or burn out they can be easily replaced by exchanging LED connector module 12. In addition, entirely new video or lighting displays can be created by adding, removing or rearranging assemblies 10 as needed. For example, a large lighting or video display can have many separate lengths of cable 16 each of which can include a number of assemblies 10. Such lengths of cable 16 can be removed to create a smaller lighting or video display or additional lengths having assemblies 10 can be added to produce a larger light or video display.

Modules 12 can also be any number of other electrical devices. For example, module 12 can be a smoke detector fixture, light and/or motion detection sensor, or camera or other imaging device, among other electrical fixtures. These different modules 12 can be included on one length of cable 16 for providing many of the electrical needs of a project such as new building construction. The number of modules 12 can be limited only by the type and length of cable 16 and the power usage of modules 12. In one embodiment of an electrical system according to the present disclosure, a cable 16 can have 256 LED assemblies 10 on one separate length of cable 16.

Figure 3:
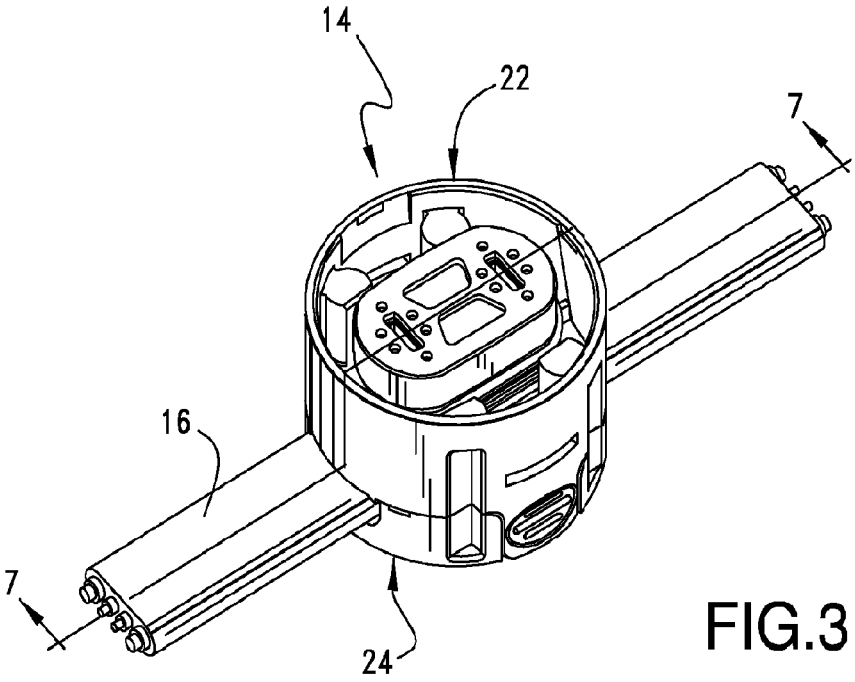
FIG. 3 shows a perspective view of one embodiment of an insulated cable terminated with a cable connector according to the present disclosure.
Figure 4:
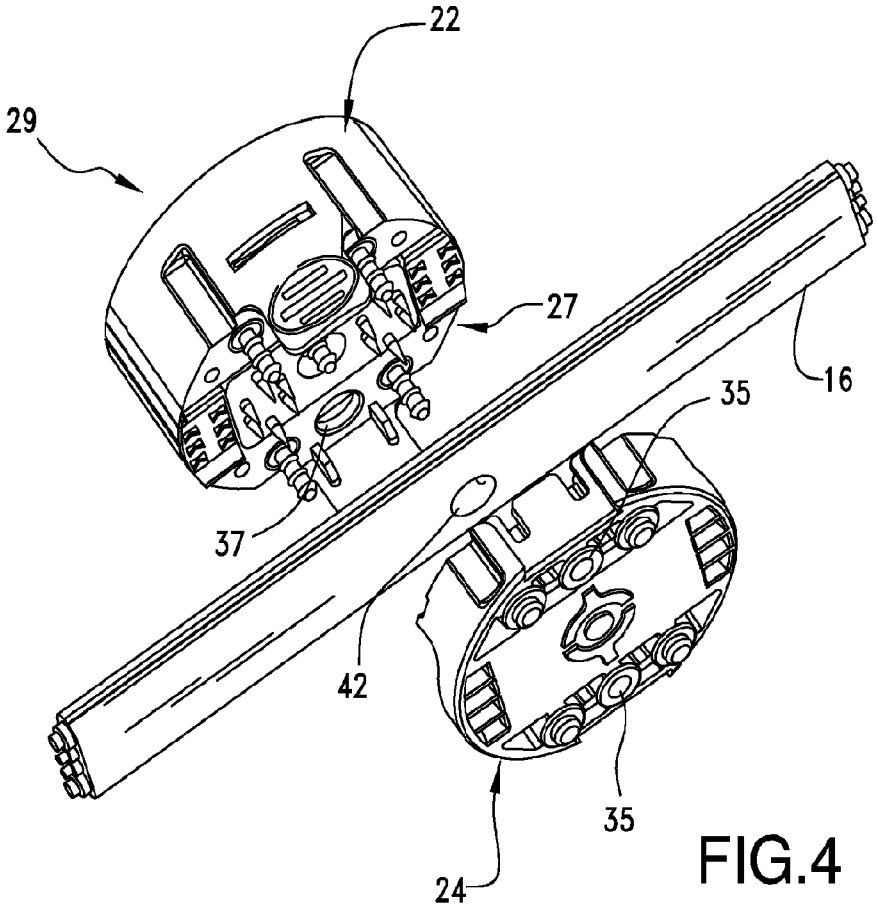
FIG. 4 shows a perspective view of the separated upper and lower portions of the cable connector and insulated cable shown in FIG. 3.

FIG. 3 shows one embodiment of cable 16 terminated with cable connector 14. Cable connector 14 can have upper portion 22 and lower portion 24 that when brought together and mated form an electrical connection with cable 16. FIG. 4 illustrates upper and lower portions 22, 24 separated from each other and cable 16 prior to mating. A rigid insulating material can be used to form the housing of upper and lower portions 22, 24 such as any number of plastics and plastic alloys, rubber and rubber alloys, silicon and silicon alloys and combinations thereof. Such materials can also incorporate fillers such as glass fibers. In one embodiment, the housing of upper and lower portions can be made of a glass filled polybutylene terephthalate (PBT) and poly carbonate (PC) alloy, and in particular a PBT/PC 30% glass fill.

Figure 5:
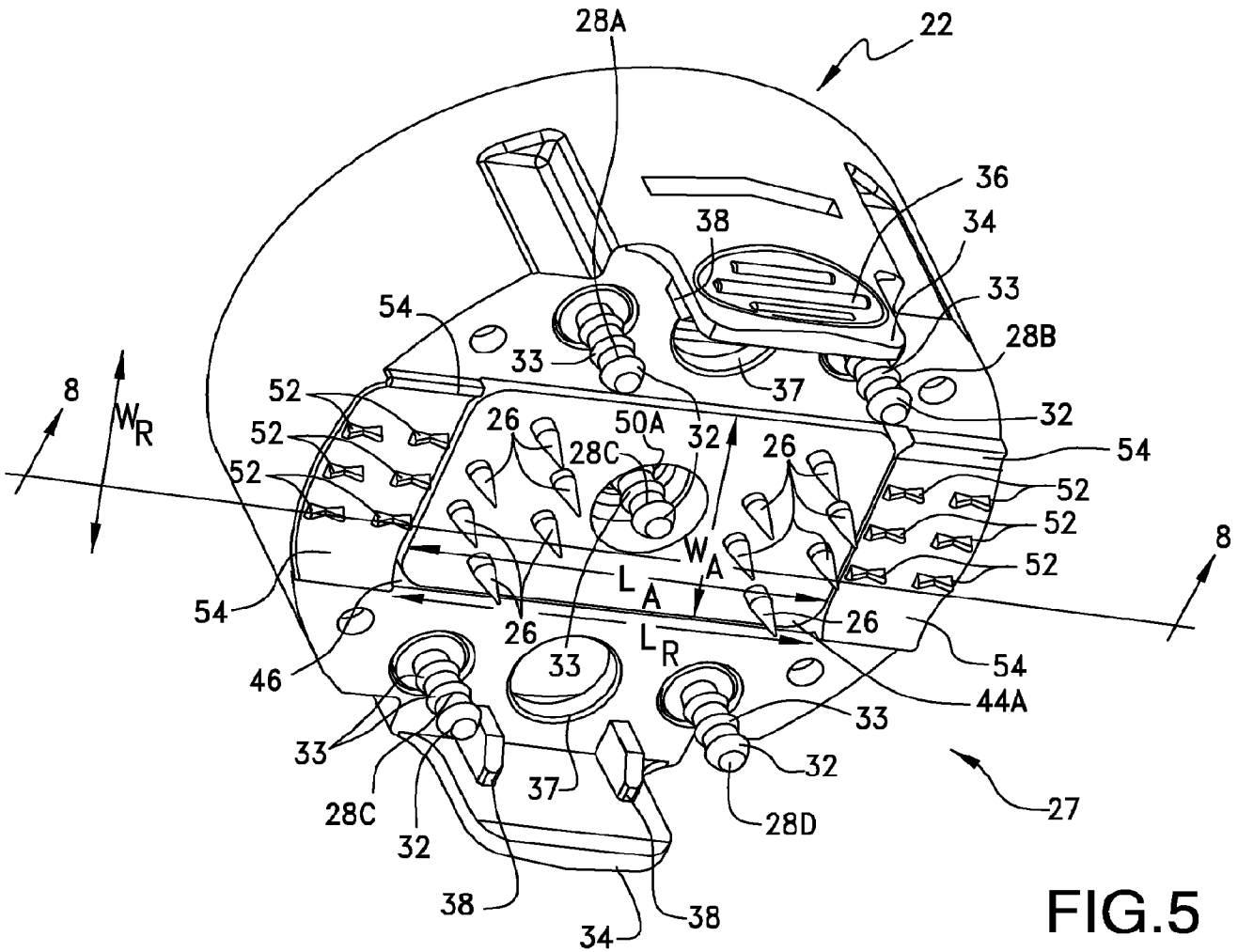
FIG. 5 shows a perspective view of the bottom end one embodiment of an upper portion of a cable connector according to the present disclosure.

Upper portion 22 can have bottom end 27 for engagement with lower portion 24 and top or module mating end 29 for engaging module 12. Cable piercing pins 26 can extend out from bottom end 27 of upper portion 22 as shown in FIG. 5. Piercing pins 26 can be positioned to pierce through the insulation of cable 16 and to contact either signal carrying strands 18A, 18B or power carrying strands 20A, 20B when upper and lower portions 22, 24 are pressed together against cable 16. Piercing pins 26 can be made of any number of conductive materials such as metals, metal alloys, and metal plated structures. In one embodiment, piercing pins 26 can be a brass alloy with plated gold over nickel.

Figure 6:
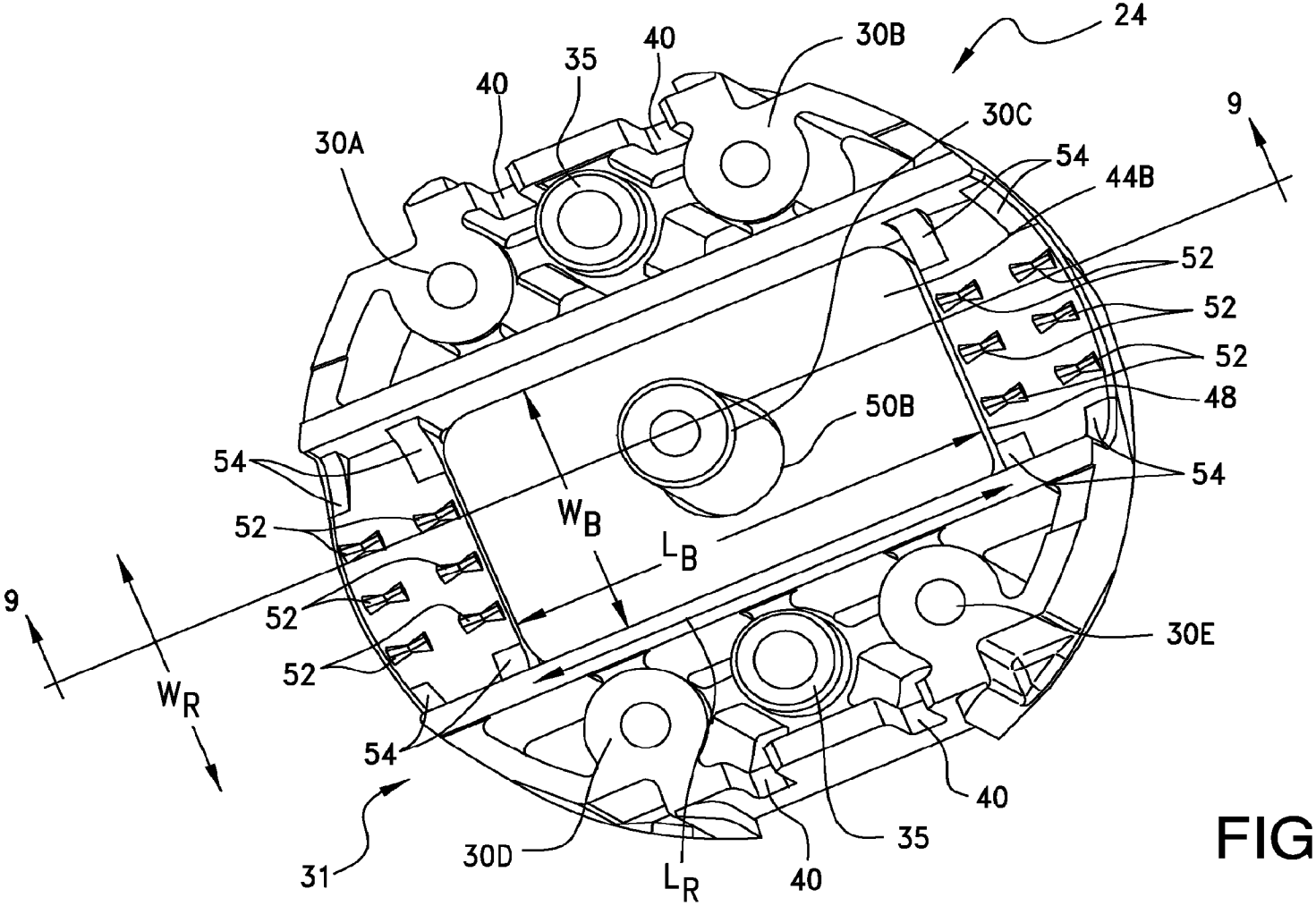
FIG. 6 shows a perspective view of the cable facing end of one embodiment of a lower portion a cable connector according to the present disclosure.

FIG. 6 shows cable facing end 31 of lower portion 24. In order to lock upper portion 22 to lower portion 24, barbed studs 28A, 28B, 28C, 28D, 28E can mate with posts 30A, 30B, 30C, 30D, 30E of lower portion 24 shown in FIG. 6. Leading barb 32 of studs 28 can be tapered to allow less force for mating upper portion 22 to lower portion 24. Leading barb 32 as well as upper barbs 33 can be sized to require a larger force to disconnect. In one embodiment, the force for mating can be from about 1200 N to about 2500 N and the force for disengagement can be from about 500 N to about 1500 N. It is understood that piercing pins 26 can contribute to the force needed to mate upper portion 22 and lower portion 24 such as for example about 50 N for each pin 26 to penetrate cable 16. Barbed studs 28 can be constructed of any number materials having high mechanical strength such as metal and plastic. In one embodiment, barbed studs 28 can be made of brass. It is understood that more or fewer studs 28A-E and complementary posts 30A-E can be used.

Lower portion 24 and upper portion 22 can include bosses 35 and boss receivers 37, respectively as shown in FIGS. 4-6 which accept screws (not shown) to permit strengthening the attachment between upper and lower portions 22, 24.

Upper portion 22 can have downwardly extending arms 34 having textured finger wells 36 to assist in applying upper portion 22 to cable 16 and lower portion 24. Pegs 38 can be used to both support arms 34 and to serve as stops when received in grooves 40 of lower portion 24. This prevents upper portion 22 from excessively compressing cable 16 when mating with lower portion 24 and signals when upper portion 22 is fully mated to lower portion 24. Finger wells 36 also assist in separating module 12 from cable connector 14.

Figure 7:
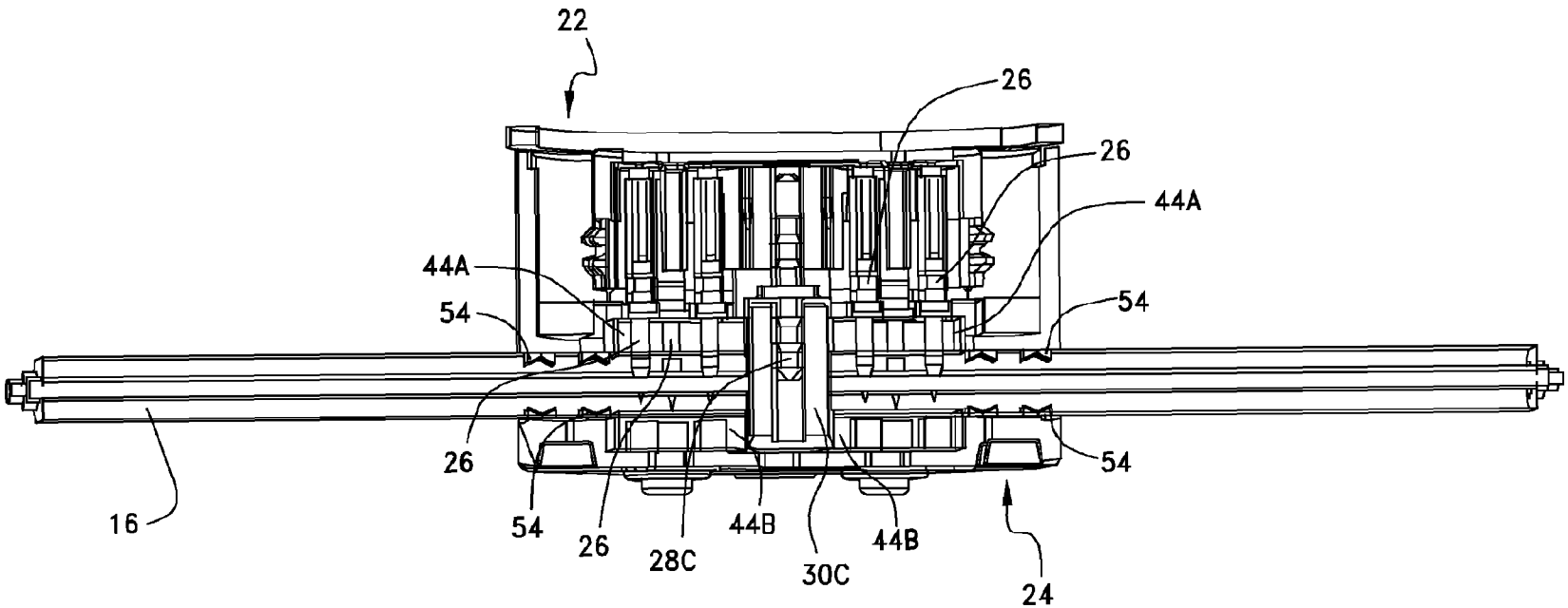
FIG. 7 shows a cross-sectional view taken at line 7-7 shown in FIG. 3.

As shown in FIG. 4, hole 42 can be punched through cable 16 to allow centrally located post 30C which receives central barbed stud 28C to pass therethrough should these be utilized. Upper and lower portions 22, 24 can then be brought together locking upper and lower portions 22, 24 against cable by studs 28A-E press fit and frictionally held in posts 30A-E until pegs 38 contact grooves 40. As shown in FIG. 7, pierce pins 26 penetrate cable 16 to contact the conductor of inner wire strands 18A, 18B. In order to seal the compromised area of cable 16 such as hole 42 and openings created by pierce pins 26, gel mats 44A and 44B can be used above and below the compromised area of cable 16, respectively.

In addition, hole 42 can be used to completely sever signal carrying strands 18A-B should module 12 need to process an incoming signal before transmitting a signal either to a subsequent module 12 or back to the source of the signal. In such a scenario, piercing pin 26 can be included on both sides of hole 42 in the direction of the length of cable 16 and connected by PCB 82 and/or processor (not shown) of module 12 so that signals can be received and transmitted with or without processing around hole 42.

Figure 8:
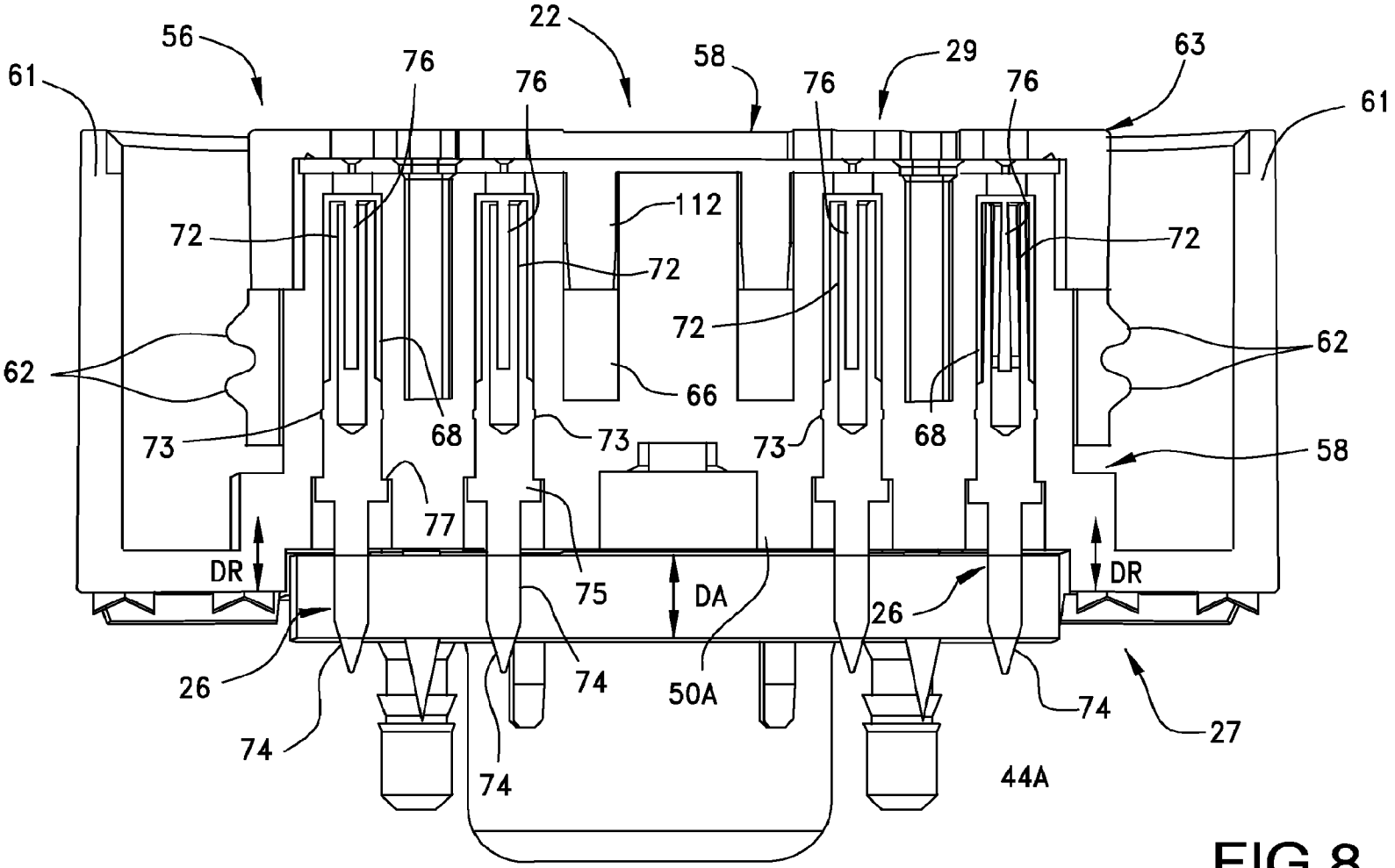
FIG. 8 shows a cross-sectional view taken at line 8-8 shown in FIG. 5.
Figure 9:
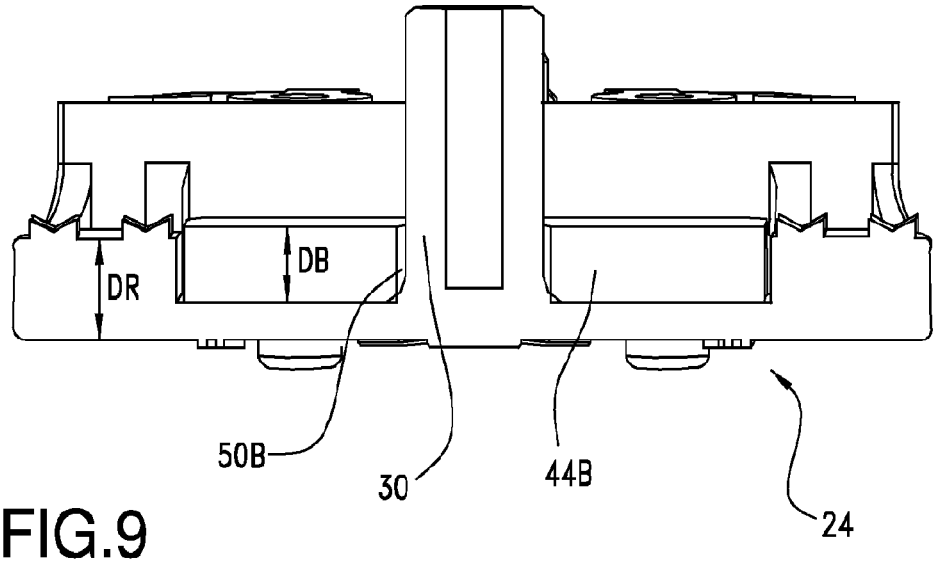
FIG. 9 shows a cross-sectional view taken at line 9-9 shown in FIG. 6.

As shown in FIGS. 5 and 6, upper portion 22 can have recessed area 46 which surrounds all of the piercing pins 26 and centrally positioned stud 28C for receiving gel mat 44A. Lower portion 24 can have a similarly sized recessed area 48 surrounding centrally positioned post 30C and aligned with recessed area 46 for receiving another gel mat 44B. Gel mats 44A and 44B can have length $L_A$ and width $W_A$ and length $L_B$ and width $W_B$, respectively that can be slightly less than the length $L_R$ and width $W_R$ of recesses 46, 48, and can have apertures 50A and 50B sized slightly larger than centrally positioned post 30. In order to create a seal, gel mats 44A and 44B can have a depth $D_A$, $D_B$, respectively that is slightly greater than the depth $D_R$ of recesses 46, 48, respectively as shown in FIGS. 8 and 9 so that when upper and lower portions 22, 24 are mated together gel mats 44A and 44B can be compressed to fill any void spaces of recessed areas 46, 48. In one embodiment, length $L_R$ and $W_R$ of recessed areas 46, 48 can be from about 1% to about 10% greater than length $L_A$, $L_B$ and $W_A$, $W_B$ of gel mats 44A and 4B, respectively and depth $D_A$ and $D_B$ of gel mats gel mats 44A and 44B can be from about 20% to about 50% greater than depth $D_R$ of recessed areas 46 48. In another embodiment, gel mats 44A and 44B can be compressed from about 10% to about 25%.

In the embodiment shown in FIGS. 5 and 6, recessed areas 46, 48 can have the same dimensions and correspondingly, gel mats 44A, 44B also can have the same dimensions. In the embodiment illustrated in FIGS. 5 and 6, recessed areas 46, 48 can have the same length L, width W and depth D of about 25.8 mm, 15.35 mm, and 2.25 mm, respectively and gel mats 44A, 44B have the same length L, width W, and depth D of about 25.1 mm, 14.6 mm and 3.0 mm, respectively. In the same embodiment, centrally positioned post 30C can each have a radius of from about 1 to about 5 mm and apertures 50A, 50B of gel mats 44A and 44B, respectively can each have a radius from 2% to 25% greater than the radius of post 30C. In one embodiment. Post 30C can have a radius of about 2.5 mm and apertures 50A and 50B each can have a radius of about 10% greater than the radius of post 30C.

Gel mats 44A, 44B can be constructed of any number of flexible or compressible insulating and water resistant materials. For example gel mats 44A, 44B can be made of silicone, rubber and plastics and alloys thereof. In one embodiment, gel mats 44A, 44B can be silicone rubber suspended in a polyurethane foam.

Upper and lower portions 22, 24 can also have teeth 52 to relieve strain on piercing pins 26 which could arise upon movement of cable 16. Teeth 52 can be located at opposite ends of each recessed areas 44A, 44 in the direction of cable 16 and their configuration and numbers can vary depending on the application. Teeth 52 extend from upper and lower portion 22, 24 such that when upper and lower portions are locked against cable 16 teeth 52 engage insulation of cable without breaking through the insulation. For example, teeth 52 can compress against jacket 17 from about 0.2 to about 1 mm and in one embodiment teeth 52 compress about 0.5 mm into jacket 17 when upper and lower portions 22, 24 are fully engaged. Ramps 54 can also be included to bracket cable 16 and limit side-to-side motion perpendicular to direction of cable.

Figure 10:
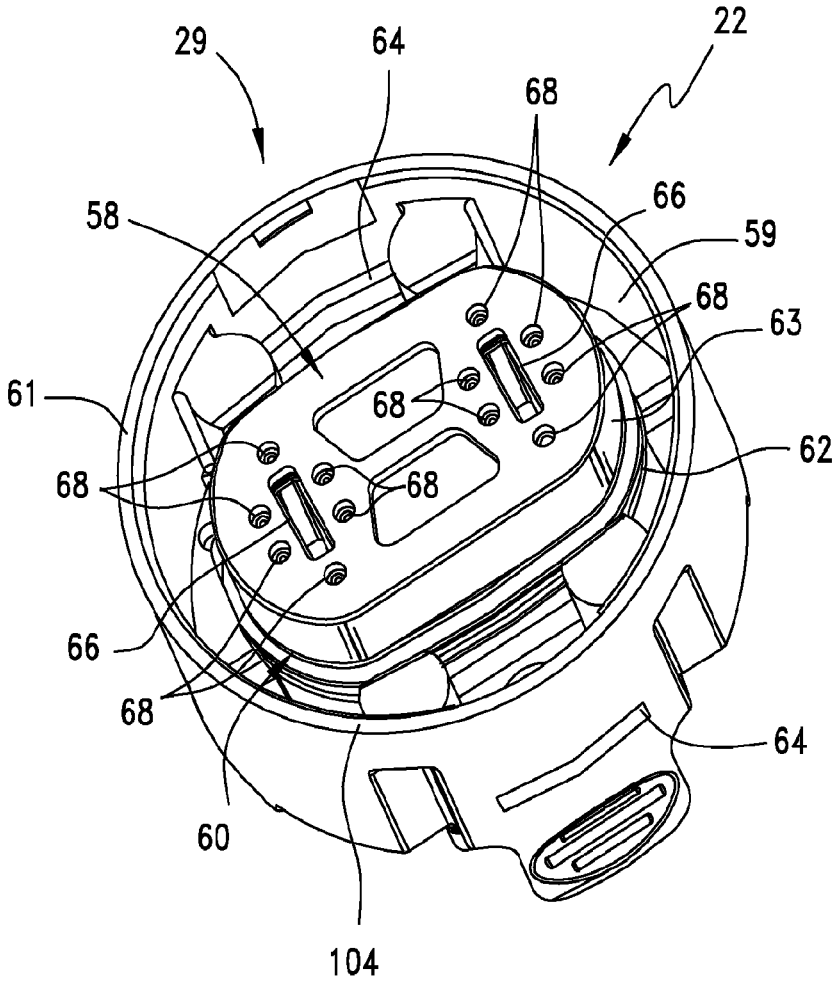
FIG. 10 shows a perspective view of the top end of one embodiment of an upper portion of a cable connector according to the present disclosure.

Moving to FIG. 10, top end or module mating end 29 of upper portion 22 is shown. At about the center of top end 29 of upper portion 22 can be a raised platform or socket 58. Groove 59 can separate socket 58 from outer wall 61 of upper portion. Flexible sleeve 60 having ridges 62 which are shown more clearly in FIG. 8 can be placed around socket 58. Ridges 62 interact with module 12 to create a water tight seal. Sleeve 60 can be made of a water tight and flexible material such as rubber or other similar materials. In one embodiment, sleeve 60 can be a silicon rubber impregnated with lubricant and commonly referred to as a lubricated silicone rubber. Such lubricated rubber silicones allow repeated engagement with a sealing surface without significantly affecting the sealing characteristics. In one embodiment, sleeve 60 and gel mats 44A-B can provide cable connector 14 with a rating of IP X4 up to a IP 66/67 rating.

Cap 63 can be placed over sleeve 60 to secure sleeve 60 to socket 58. Cap 63 can be made of the same insulated material as upper and lower portions 22, 24 and can have openings that match and align with contact openings 68 and alignment slots 66. Cap 63 can also serve as a splash guard when upper portion 22 is exposed prior to engagement with led module 12.

Outer wall 61 can have opposing retaining slots 64 adjacent and above finger wells 36 for mating with module 12. Socket 58 can have two alignment slots 66 to facilitate aligning module 12 with cable connector 14 during mating. Alignment slots 66 can also provide addition frictional retention force between module 12 and connector 14.

Figure 11:
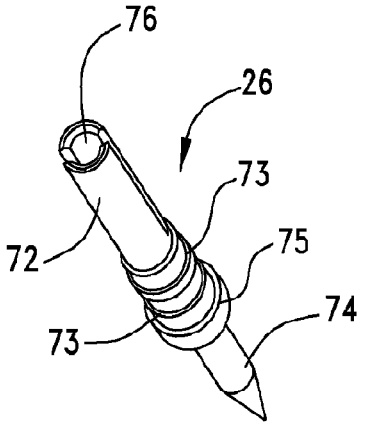
FIG. 11 shows a perspective view of one embodiment of a piercing pin according to the present invention.

Contact openings 68 can be included in socket 58 for accepting terminal or mating pins 70 of module 12 shown in FIGS. 1 and 11. As shown in FIG. 8, upper end 72 of piercing pins 26 can be seated in contact openings 68. Opposite upper end 72 can be piercing end 74 and generally midway therebetween can be annular ribs 73 and annular ridge 75. Annular ridge 75 can engage shoulder 77 of contact opening 68 near the bottom end 27 of upper portion 22 to prevent pierce pins 26 from sliding toward modular mating end 29. Annular ribs 73 engage interior walls of contact openings 68 to prevent movement of pierce pins 26 towards bottom end 27. Upper end 72 can have a slotted opening 76 as also shown in FIG. 11.

Figure 12:
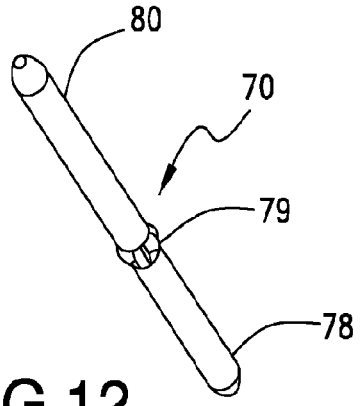
FIG. 12 shows a perspective view of one embodiment of a mating pin according to the present invention.

Mating pins 70 shown in FIG. 12 can have a connector mating end 78 and module end 80. Positioned generally centrally on pin 70 are ribs 79 for retaining pin 70 to module 12 through friction fit. Mating pins 70 can be constructed of a wide variety of conductive materials such as metals and metal alloys. The same material used to make piercing pins 26 can be used for mating pins 70 such as for example brass alloy with plated gold over nickel.

Slotted opening 76 can receive connector end 78 for making the electrical connection between module 12 and cable connector 14. Slotted opening 76 can be tapered so that opening narrows towards piercing end 74. This allows greater retention and can prevent mating pins from undesired movement further into slotted opening 76. Alternatively, mating pin 70 can be tapered such that mating pin 70 becomes wider from connector end 78 towards the midsection of pin 70.

Figure 13:
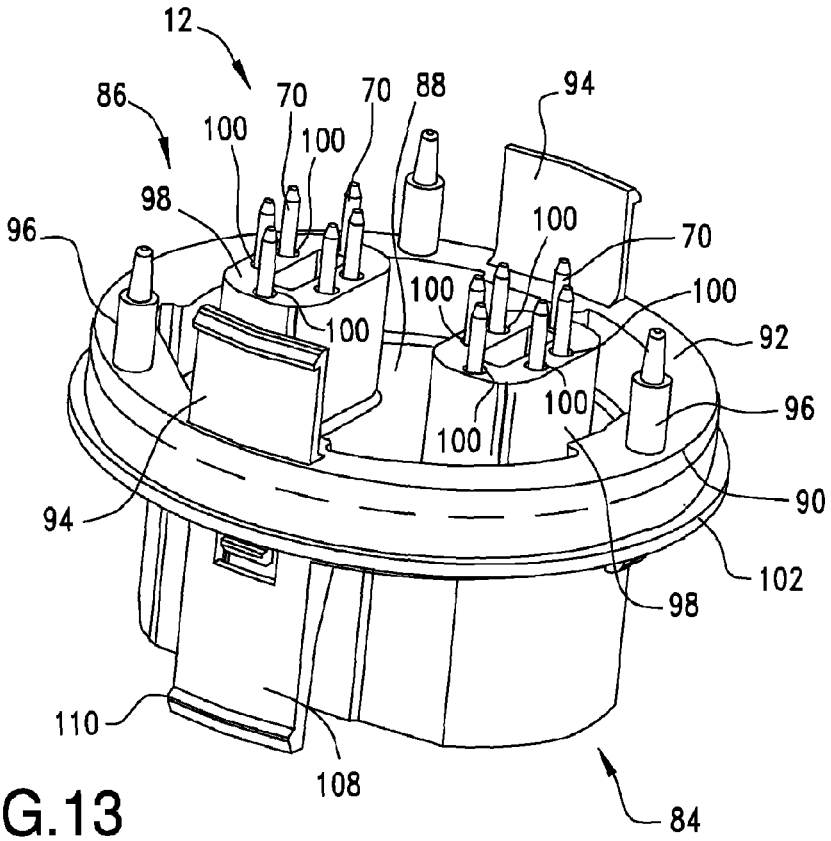
FIG. 13 shows a perspective view of one embodiment of an electrical module according to the present invention.
Figure 14:
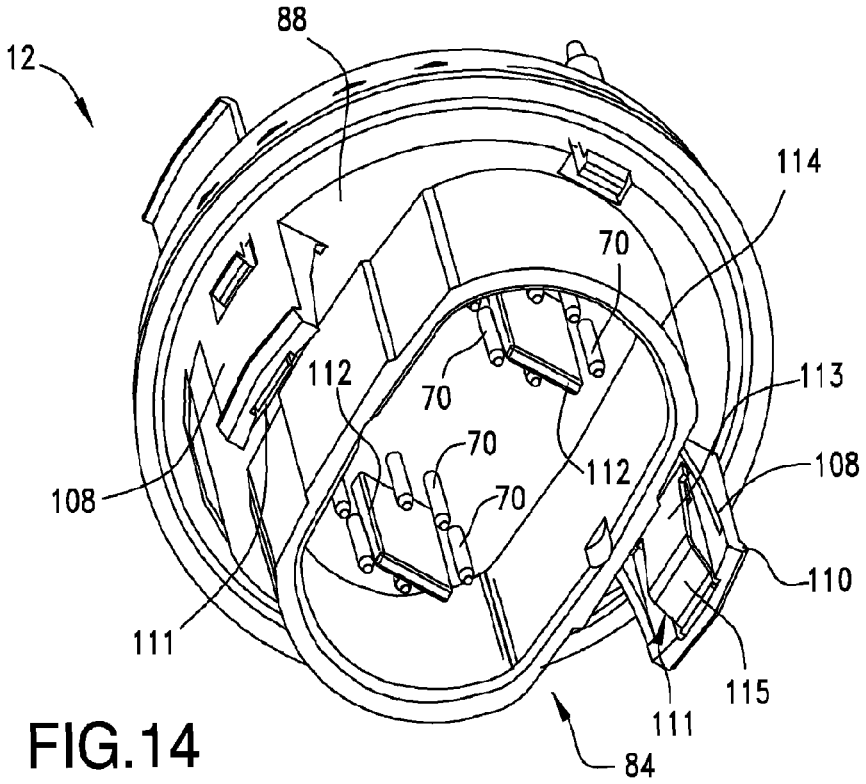
FIG. 14 shows a perspective view of the bottom end of the electrical module shown in FIG. 13.

FIGS. 13 and 14 show one embodiment of module 12 which is the same as module 12 shown in FIGS. 1 and 2 but lacking PCB 82. Module 12 as illustrated in FIGS. 13 and 14 can be an LED connector. LED connector module can connect to an LED fixture (not shown). The housing of module 12 can be constructed of any number of rigid insulating materials such as a strong rigid plastic. In one embodiment the housing of module 12 can be made of the same material as cable connector 14 such as 30% glass filled PBT/PC alloy. Module 12 can have bottom or connector engagement end 84 and LED fixture engagement end 86. Base wall 88 can be surrounded by a circular wall 90. Extending radially from top end of circular wall 90 can be raised annular wall 92. Extending from opposite ends of annular ring 92 and axially upwards towards fixture engagement end can be fixture locking arms 94 for securing the LED fixture (not shown) to module 12. Three support posts 96 extending from annular ring 92 and spaced an equal distance apart from each other can be included for supporting PCB 82 to module 12. It is understood that fewer or more posts 96 can be used and can be arrangement in any appropriate manner.

Figure 15:
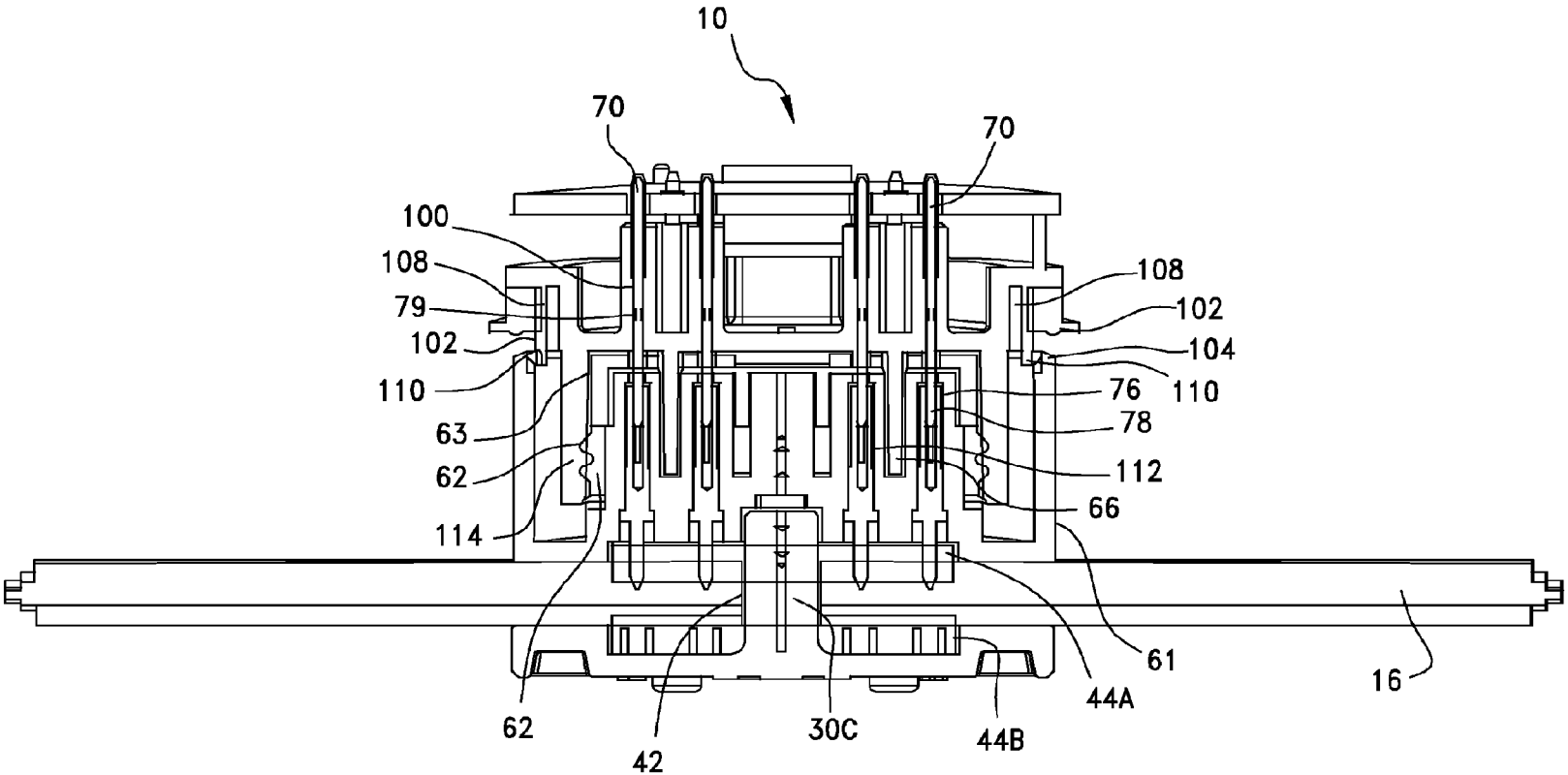
FIG. 15 shows a cross-sectional view taken at line 15-15 shown in FIG. 1.

Two support towers 98 can extend upwards from base 88. Mating pin openings 100 extend through support towers 98 to receive mating pins 70 which can be held firmly in place by frictional fit engagement of ribs 79 to walls of mating pin openings 100 as shown in FIG. 15. Support towers 98 can be spaced apart from each other and from annular ring 92. It is understood that module 12 can have more towers 98, a single tower 98 or an altogether different support structure for pins 70.

Below annular ring 92 can be gasket 102. Gasket 102 can be made from an elastomer and can provide additional sealing from water, dust and the like.

Staying with FIG. 14, module latching arms 108 can extend from base wall 88 in the mating direction. Module latching arms 108 can engage with retaining slots 64 more clearly shown in FIG. 10 for releasably latching module 12 to upper portion 22 of cable connector 14. Angled projections 110 of latching arms 108 can engage slots 64 to resist disengagement of module 12 to upper portion 22. Projections 110 can be structured to require a predetermined amount of force to pull apart or disengage module 12 from upper portion 12. Pulling module 12 apart from upper portion 22 with the predetermined force can cause latching arms to flex inwardly towards each other to the point where projections 110 no longer engage retaining slots 64. In one embodiment, angled projections 110 and the resiliency of latching arms 108 can require from about 30 N to about 100 N of force to disengage module 12 from upper portion 22 of cable connector 14.

In addition to adjusting projections 110 and/or the resiliency of latching arms 108, the amount of force required to pull apart or disengage module 12 from upper portion 22 can be increased with cantilevered spring clips 111 that can extend from base wall 88 behind latching arms 108 in supporting relation as shown in FIG. 14. Spring clips 111 can abut latching arms directly behind the location of projections 110 or can be minimally spaced apart therefrom such that spring clips 111 provided additional resistance against inward movement of latching arms 108 and disengagement of projections 110 from retaining slots 64. Spring clips can be made from any number of sturdy resilient materials such as metal or plastic. Spring clip can be bent such that an upper section 113 extends away from its respective latching arm 108 and a lower section 115 extending back towards its respective latching arm 108. In one embodiment, spring clips 111 and can be made out of about 0.4 mm thick stainless steel sheet and can provide approximately an additional 35 N force to the force required to pull apart module 12 from upper portion 22.

Two aligning tabs 112 can extend in the mating direction from base wall 88 and can be received in aligning slots 66. Tabs 112 can facilitate alignment of module 12 for mating with upper portion 22 of cable connector 14 which reduce the risk of damages pins 70 during mating.

Annular skirt 114 can also extend in the mating direction from base wall and surround tabs 112. As shown in FIG. 15, annular skirt 114 cooperates with ridges 62 to create water proof seal. In the embodiment shown in FIG. 15, when upper and lower portion 22, 24 are locked together against cable 16 and module 12 is attached to cable connector 14, the seal created by gel mats 44A, 44B and the interfacial seal created by ridges 62 of sleeve 60 interacting with annular skirt 114 can combine to produce a rating of IP 66/67 for assembly 10.

A description of the steps needed to terminate cable 16 with cable connector 14 and attach module 12 to cable connector will now be discussed.

Hole 42 can be punched through cable 16 if cable connector 14 includes a central stud 28C and post 30C. Lower portion 24 can have gel mat 44B placed in recessed area 48 or can be provided with gel mat 44B already secured in recessed area 48. Central post 30C of lower portion 24 can be passed through hole 42 and cable 16 laid against gel mat 44B. Similarly, upper portion 22 can have gel mat 44A placed in recessed area 46 or can be provided with gel mat 44A already secured in recessed area 46. Upper portion 22 can then be brought towards cable 16 and studs 28A-E can be aligned over posts 30A-E. Although not shown, studs 28A-E can enter posts 30A-E prior to piercing pins 26 contacting cable 16.

Upper and lower portions 22, 24 can then be forced together against cable 16 until pegs 38 contact grooves 40 shown in FIGS. 5 and 6, resist further mating. Piercing pins 26 penetrate cable 16 and can make contact with wires 18A-B, 20A-B and gel mats 44A-B are compressed and flow to fill any voids spaces in and around recessed areas 46, 48 respectively. The electrical connection between piercing pins 26 and cable 16, sealed by gel mats 44A-B can have a rating of IP X4 up to a rating of IP 66/67. The engagement between upper and lower portions 22, 24 can be strengthen with screws placed in bosses 35 and boss receivers 37.

Electrical module 12 can come preassembled with pins 70 seating in openings 110, and can have a electrical fixture attached thereto prior to mating with cable connector 14 or can be attached thereafter. Module 12 can be brought towards module mating end 29 of upper portion 22 and tabs 112 can be positioned to align with slots 66. With further movement towards cable connector, tabs 112 enter slots 66 and thereafter pins 70 enter openings 60. Attachment of module 12 can be completed when tabs 112 resist further entry into slots 66, pins resist further entry in openings 60 and/or when projections 110 of latch arms 108 engage retaining slots 64. Skirt 114 engages ridges 62 of sleeve 60 to create a seal. The combination of the seal between skirt 114 and sleeve 60 and the seal created by gel mats 44A-B can result in an weather proof rating of IP66/67.

With mating ends 78 of pins 70 seated in slotted opening 76 of piercing pin 26, module 12 is electrically connected to cable connector 14 and to cable 16 via pierce pin contacting wire strands 18A-B, 20A-B (shown in FIG. 1) as shown in FIG. 15. Module 12 can be disengaged from cable connector 14 in a pull off motion in a direction opposite the mating direction.

It should be understood that various changes and modifications to the embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A cable connector for terminating an insulated cable having wire strands, the cable connector comprising:

a) an upper portion having:

1) a top end for interacting with an electrical module, a bottom end for interacting with insulated cable and a plurality of cavities extending therebetween including a socket housing said plurality of cavities and a flexible sleeve positioned around the socket and having ridges for forming an interfacial seal with an electrical module;

2) a first recessed area;

3) a first gel mat positioned in the recessed area; and 4) a plurality of piercing pins, each piercing pin seated in one of the cavities and having a piercing end extending outward from the bottom end and through the first gel mat and a slotted opening opposite the piercing end;

b) a lower portion lockable to the upper portion and having:

1) a cable receiving end having a second recessed area aligned with the first recessed area when upper and lower portions are locked together and a second gel mat positioned in the second recessed area;

wherein placement of the insulated cable on the receiving end of lower portion and locking of upper portion to lower portion causes piercing pins to penetrate insulated cable and to make contact with wire strands and causes the first and second gel mats to compress and flow to seal penetrated insulated cable.

2. The cable connector of claim 1 wherein one of the upper portion and lower portion includes at least two barbed studs and the other of the upper and lower portion includes at least two posts, each post receiving one barbed stud to lock upper and lower portions together.

3. The cable connector of claim 1 wherein each of the upper and lower portions includes at least one strain-relief projection positioned adjacent opposite longitudinal ends of each of the first and second recessed areas for gripping and reducing movement of insulated cable.

4. The cable connector of claim 1 further comprising an electrical module including a bottom end for interacting with the cable connector, a top end, a plurality of terminal pins, each terminal pin secured in a passage and having a first end extending out the top end of the module and a second end extending out the bottom end of the module, and a skirt for sealing engagement with the cable connector, each of the second ends of the plurality of terminals pins seated respectively within one of the slotted openings of the plurality of piercing pins to electrically connect the electrical module to the cable connector.

5. The cable connector of claim 1 wherein the upper portion includes a central barbed stud passing through the first gel mat and four perimeter barbed studs and the lower portion includes a central post passing through the second gel mat and four perimeter posts, each of the posts receiving one of the barbed studs to lock upper portion to lower portion.

6. The cable connector of claim 5 wherein the central post passes through an aperture in the insulated cable and wherein locking upper portion and lower portion compress first and second gel mats causing first and second gel mats to flow and seal penetrations of piercing pins and aperture of insulated cable.

7. An electrical assembly comprising: a cable connector for terminating a stranded-wire insulated cable and for releasably attaching to an electrical module to electrically connect the electrical module to the stranded-wire insulated cable; the electrical module including a bottom end for interacting with the cable connector, a top end, a plurality of terminal pins, each terminal pin secured in a passage and having a first end extending out the top end and a second end extending out the bottom end, and a skirt for sealing engagement with the cable connector;

a) the cable connector including an upper portion and lower portion lockable against the stranded-wire insulated cable;

1) the upper portion including;

i) an upper end for interacting with electrical module and a lower end for interacting with the stranded-wire insulated cable;

ii) a first recessed area having a first gel mat seated therein; and iii) a plurality of piercing pins, each piercing pin having a slotted opening opposite a piercing end, and the slotted opening of each piercing pin positioned in a cavity having a hole at the upper end and the piercing end extending out of a hole at the lower end and passing through the first gel mat, each hole at the upper end receiving the bottom end of one of the plurality of terminal pins which is mated within the slotted opening of one of the plurality of piercing pins to electrically connect the electrical module to the cable connector; and 2) the lower portion includes a cable facing end, wherein the stranded-wire insulated cable is positioned on the lower portion and locking upper portion to lower portion causes piercing ends to penetrate stranded-wire insulated cable and contact conductors therein to electrically connect cable connector to stranded-wire insulated cable and causes first gel mat to seal the terminated stranded-wire insulated cable and wherein the cable facing end includes a second recess having a second gel mat seated therein and one of the first recess of upper portion and the second recess of the lower portion includes a central barbed stud extending therefrom and through the first or second gel mat, respectively, and the other of the first recess of upper portion and the second recess of the lower portion includes a central post extending therefrom and through the other of the first and second gel mat, respectively for receiving the barbed stud to lock upper and lower portions together and wherein the stranded wire insulated cable includes an aperture for allowing passage of the central post and locking upper and lower portions against stranded-wire insulated cable compresses first and second gel mats sealing the cable connector to stranded-wire insulated cable.

8. The electrical assembly of claim 7 wherein the upper end of upper portion includes arms positioned at opposite sides of the upper portion, each arm having a finger well on one side and a peg on an opposite side, the lower portion having a groove for accepting the peg to prevent further movement of upper portion towards lower portion during locking of upper and lower portion against stranded-wire insulated cable.

9. The electrical assembly of claim 7 wherein the electrical module includes latching arms positioned at opposite sides of electrical module and extending towards the bottom end, each latching arm having a projection at an end thereof, and the upper portion having a slot positioned at opposite sides thereof for receiving the projections to latch electrical module to cable connector.

10. The electrical assembly of claim 7 wherein the electrical module includes a flexible ring for sealing against top face of upper end of upper portion.

11. The electrical assembly of claim 7 wherein each of the upper and lower portions includes at least one strain-relief projection positioned adjacent opposite longitudinal ends of each of the first and second recessed areas for gripping and reducing movement of stranded-wire insulated cable.

12. An electrical assembly comprising: a cable connector for terminating a stranded-wire insulated cable and for releasably attaching to an electrical module to electrically connect the electrical module to the stranded-wire insulated cable; the electrical module including a bottom end for interacting with the cable connector, a top end, a plurality of terminal pins, each terminal pin secured in a passage and having a first end extending out the top end and a second end extending out the bottom end, and a skirt for sealing engagement with the cable connector;

a) the cable connector including an upper portion and lower portion lockable against the stranded-wire insulated cable;

1) the upper portion including;

i) an upper end for interacting with electrical module and a lower end for interacting with the stranded-wire insulated cable;

ii) a first recessed area having a first gel mat seated therein; and iii) a plurality of piercing pins, each piercing pin having a slotted opening opposite a piercing end, and the slotted opening of each piercing pin positioned in a cavity having a hole at the upper end and the piercing end extending out of a hole at the lower end and passing through the first gel mat, each hole at the upper end receiving the bottom end of one of the plurality of terminal pins which is mated within the slotted opening of one of the plurality of piercing pins to electrically connect the electrical module to the cable connector; and 2) the lower portion includes a cable facing end, wherein the stranded-wire insulated cable is positioned on the lower portion and locking upper portion to lower portion causes piercing ends to penetrate stranded-wire insulated cable and contact conductors therein to electrically connect cable connector to stranded-wire insulated cable and causes first gel mat to seal the terminated stranded-wire insulated cable, wherein the upper portion includes a socket having at least one alignment slot for receiving at least one alignment tab, the at least one alignment tab extending from the bottom end of the electrical module beyond the second end of the plurality of terminal pins for entering the at least one alignment slot prior to the second end of the plurality of terminal pins entering the holes at upper end of the upper portion.

13. The electrical assembly of claim 12 wherein either the second end of each terminal pin or the slotted opening of each piercing pins is tapered to increase mating contact and frictional fit between the second end and the slotted opening.

* * * * *